US007728067B2

(12) United States Patent
Peter et al.

(10) Patent No.: US 7,728,067 B2
(45) Date of Patent: Jun. 1, 2010

(54) ACID DONORS FOR DYEING POLYAMIDE

(75) Inventors: Hans-Jorg Peter, Basel (CH); Claudius Brinkmann, Lorrach (DE)

(73) Assignee: Huntsman International LLC, The Woodlands, TX (US)

( * ) Notice: Subject to any disclaimer, the term of this patent is extended or adjusted under 35 U.S.C. 154(b) by 630 days.

(21) Appl. No.: 11/579,460

(22) PCT Filed: Apr. 25, 2005

(86) PCT No.: PCT/EP2005/051828

§ 371 (c)(1),
(2), (4) Date: Nov. 3, 2006

(87) PCT Pub. No.: WO2005/106107

PCT Pub. Date: Nov. 10, 2005

(65) Prior Publication Data

US 2008/0271260 A1 Nov. 6, 2008

(51) Int. Cl.
*D06M 13/224* (2006.01)
*D06M 13/47* (2006.01)

(52) U.S. Cl. ..... 525/47; 8/115.58; 8/115.59; 8/582; 8/565; 8/568; 8/573

(58) Field of Classification Search ..... 8/636, 8/582; 525/182
See application file for complete search history.

(56) References Cited

U.S. PATENT DOCUMENTS

| | | | | |
|---|---|---|---|---|
| 2,379,309 | A * | 6/1945 | Malm et al. | 536/64 |
| 4,168,142 | A | 9/1979 | Hervot et al. | |
| 4,568,351 | A | 2/1986 | Palleiro Cardona et al. | |
| 5,718,732 | A | 2/1998 | Bennett et al. | |
| 2002/0055619 | A1 * | 5/2002 | Dietz et al. | 534/579 |
| 2004/0253370 | A1 * | 12/2004 | Hoersch | 427/175 |

FOREIGN PATENT DOCUMENTS

| | | | |
|---|---|---|---|
| DE | 3417780 | A1 | 11/1984 |
| DE | 19626812 | A1 | 1/1997 |

OTHER PUBLICATIONS

EIC Search, completed by STIC on Apr. 17, 2009.*

* cited by examiner

*Primary Examiner*—Harold Y Pyon
*Assistant Examiner*—Katie Hammer

(57) ABSTRACT

An adjuvant composition comprising (A) a $C_1$-$C_2$carboxylic acid ester of a polyhydroxy compound containing from 2 to 20 hydroxyl groups and (B) an N-heterocyclic compound having a $pK_a$, value of from 6 to 8 is storage-stable and suitable as an acid donor in the dyeing of polyamides.

13 Claims, No Drawings

ACID DONORS FOR DYEING POLYAMIDE

CROSS REFERENCE TO RELATED APPLICATIONS

This application is the National Phase of International Application PCT/EP2005/051828 filed Apr. 25, 2005 which designated the U.S. and which claims priority to European (EP) Pat. App. No. 04101888.8 filed May 3, 2004. The noted applications are incorporated herein by reference.

The present invention relates to an adjuvant composition comprising a $C_1$-$C_2$carboxylic acid ester and an N-heterocyclic compound and to a method of controlling pH in textile-processing processes.

In the dyeing of textiles, so-called acid donors are frequently added to the dyeing liquor, which hydrolyse in the course of the dyeing process and, in so doing, release an acid, resulting in a slow reduction in pH. This ensures slower, more uniform exhaustion of the dyes and, as a result, better levelness of the dyeing.

In DE-A 34 17 780, formic acid esters of polyethylene glycol or polypropylene glycol are recommended as suitable acid donors.

However, those formates are very susceptible to hydrolysis and decompose to a certain extent even during storage.

The problem of the present invention was therefore to make available a homogeneous anhydrous liquid formulation of an acid donor having a high degree of storage stability.

It has now been found, surprisingly, that the tendency of certain carboxylic acid ester formulations towards hydrolysis can be substantially reduced by the addition of N-heterocyclic compounds.

The N-heterocycles can be homogeneously incorporated without any problem into anhydrous formulations, which then exhibit good storage stability even at elevated temperatures.

The present invention accordingly relates to an adjuvant composition comprising (A) a $C_1$-$C_2$carboxylic acid ester of a polyhydroxy compound containing from 2 to 20 hydroxyl groups and (B) an N-heterocyclic compound having a $pK_a$ value of from 6 to 8.

The use of formic acid esters of glycols as acid donors having pH-regulating properties in textile-processing processes is known, for example, from U.S. Pat. No. 4,568,351.

Suitable polyhydroxy compounds for the preparation of the $C_1$-$C_2$carboxylic acid esters are, for example, glycols, glycerol, trimethylolpropane, pentaerythritol and glucose and also ethylene oxide and propylene oxide addition products of those compounds.

The $C_1$-$C_2$carboxylic acid esters according to component A are known or can be prepared in accordance with known methods, for example by reacting the appropriate polyhydroxy compounds with a $C_1$-$C_2$carboxylic acid or suitable carboxylic acid derivative.

Both fully esterified and also partially esterified compounds are suitable as component A. Mixtures of fully esterified and partially esterified polyhydroxy compounds are also possible. When component A is the ester of a dicarboxylic acid (e.g. oxalic acid), it may be in the form of either a monoester or a diester, or in the form of a mixture of a monoester and diester. Preference is given to dicarboxylic acid diesters.

Suitable $C_1$-$C_2$carboxylic acids for the preparation of the $C_1$-$C_2$carboxylic acid esters are, for example, formic acid, acetic acid, chloroacetic acid, bromoacetic acid, hydroxyacetic acid and oxalic acid.

Preference is given to the use, as component A, of a $C_1$-$C_2$carboxylic acid ester of ethylene glycol or propylene glycol, of a polyethylene glycol or polypropylene glycol, of glycerol, of a glycerol/ethylene oxide addition product or glycerol/propylene oxide addition product, of glucose, of a glucose/ethylene oxide addition product or glucose/propylene oxide addition product.

Especially preferred as component A are reaction products of a $C_1$-$C_2$carboxylic acid with ethylene glycol, polyethylene glycol containing from 2 to 4 ethylene groups, propylene glycol, polypropylene glycol containing from 2 to 4 propylene groups, glycerol, glycerol/ethylene oxide addition product containing from 2 to 6 ethylene groups or glycerol/propylene oxide addition product containing from 2 to 6 propylene groups.

Also preferred as component A are formic acid esters, chloroacetic acid esters, hydroxy-acetic acid esters or oxalic acid esters of a polyhydroxy compound containing from 2 to 20 hydroxyl groups.

Especially preferred acid donors are ethylene glycol monoformate, ethylene glycol diformate, diethylene glycol monoformate, diethylene glycol diformate, ethylene glycol mono (chloro-acetate), ethylene glycol di(chloroacetate), diethylene glycol mono(chloroacetate), diethylene glycol di(chloroacetate), ethylene glycol mono(hydroxyacetate), ethylene glycol di(hydroxy-acetate), diethylene glycol mono (hydroxyacetate), diethylene glycol di(hydroxyacetate), ethylene glycol mono(oxalate), ethylene glycol di(oxalate), diethylene glycol mono(oxalate) and diethylene glycol di(oxalate).

As component B, in principle any N-heterocyclic compound is suitable which has a $pK_a$ of from 6 to 8. Such compounds may be derived, for example, from pyrrolidine, pyrrole, imidazole, benzimidazole, piperidine, piperazine, morpholine, pyridine, quinoline or isoquinoline.

Preferred components B are morpholine compounds, imidazole compounds, pyridine compounds, quinoline compounds or isoquinoline compounds.

Examples of suitable components B are imidazole, histidine, 2-methylbenzimidazole, 2-aminopyridine, 2,4-dimethylpyridine (2,4-lutidine), 2,4,6-trimethylpyridine, 1-aminoisoquinoline and 4-methylmorpholine.

As component B in the compositions according to the invention special preference is given to imidazole and 2,4-lutidine.

The ratio of components A and B in the compositions according to the invention can vary within wide ranges.

The weight ratio of components A and B is preferably from 500:1 to 4:1, especially from 100:1 to 10:1, very especially from 60:1 to 20:1.

In order to adjust the activity, an organic solvent, advantageously a glycol or glycol ether, can also be added to the compositions according to the invention.

The invention accordingly relates also to a composition comprising components A and B as defined hereinbefore and, in addition, (C) a glycol or glycol ether of formula (1)

$$R_1—(OCHR_3CH_2)_n—OCHR_3CH_2—OR_2 \quad (1),$$

wherein $R_1$ and $R_2$ are hydrogen or $C_1$-$C_{12}$alkyl, with the proviso that at least one of the radicals $R_1$ and $R_2$ is hydrogen, $R_3$ is hydrogen or methyl, and n is a number from 0 to 8.

The compounds of formula (1) are known and many are available commercially. Examples thereof are ethylene glycol, ethylene glycol monomethyl ether, polyethylene glycol, polyethylene glycol monomethyl ether, propylene glycol, propylene glycol monomethyl ether, polypropylene glycol and polypropylene glycol monomethyl ether.

Preferred compositions according to the invention comprise, as component C, a glycol of formula (1) wherein $R_1$ and $R_2$ are hydrogen and n is a number from 0 to 2.

Special preference is given to diethylene glycol and, especially, dipropylene glycol as component C.

The relative amounts of components A, B and C in the compositions according to the invention can vary within wide ranges.

Preference is given to compositions comprising (A) from 20 to 95% by weight, preferably from 30 to 90% by weight, especially from 50 to 80% by weight, of a $C_1$-$C_2$carboxylic acid ester of a polyhydroxy compound containing from 2 to 20 hydroxyl groups;

(B) from 0.2 to 10% by weight, preferably from 0.5 to 5% by weight, especially from 1 to 3% by weight, of an N-heterocyclic compound having a $pK_a$ value of from 6 to 8; and (C) from 0 to 70% by weight, preferably from 10 to 60% by weight, especially from 20 to 45% by weight, of a glycol or glycol ether of formula (1)

$$R_1—(OCHR_3CH_2)_n—OCHR_3CH_2—OR_2 \quad (1),$$

wherein $R_1$ and $R_2$ are hydrogen or $C_1$-$C_{12}$alkyl, with the proviso that at least one of the radicals $R_1$ and $R_2$ is hydrogen, $R_3$ is hydrogen or methyl, and n is a number from 0 to 8;

the sum of components (A)+(B)+(C) being, in each case, 100% by weight.

The adjuvant according to the invention may comprise, in addition to components A, B and, as the case may be, C, further customary additives such as dispersants, wetting agents and antifoams.

The present invention relates also to a method of controlling pH in textile-processing processes, wherein the processing liquor comprises an adjuvant composition as defined hereinbefore.

Textile-processing processes as understood by the present invention are, in the widest sense, dyeing, printing and brightening methods, bleaching of textiles, finishing of textiles, chlorination of wool and any such method in which pH exerts an influence on the method, but especially dyeing methods.

Textile substrates for which the method according to the invention is suitable are especially those that are finished, processed or dyed under acid conditions, for example cellulose 2½-acetate, diacetate or triacetate, modified polypropylenes, polyesters or polyacrylonitriles and, especially, natural or synthetic polyamides.

Suitable polyamide fibre material includes natural polyamide fibre material, e.g. wool or silk, and synthetic polyamide fibre material, e.g. polyamide-6 or polyamide-6.6, and fibre blends, e.g. wool/cellulose or polyamide/cellulose fibre blends, polyamide/wool fibre blends or polyamide/elastane fibre blends. The fibre material is preferably synthetic polyamide fibre material.

The textile material can be used in any form, e.g. in the form of fibres, yarn, woven fabric or knitted fabric.

The treatment of the fibre material with the adjuvant compositions according to the invention is preferably carried out in accordance with the exhaust process, in which case the liquor ratio can be selected from within a wide range and is, for example, from 1:3 to 1:100, preferably from 1:4 to 1:50 and especially from 1:5 to 1:20.

Generally, good results are obtained when the adjuvant compositions according to the invention are used in amounts of from 0.1 to 10 g/liter, preferably from 0.2 to 6 g/liter.

Special apparatus is not required. For example, customary dyeing apparatus, e.g. open baths, winch becks, jigs, or paddle, jet or circulation apparatus, may be used.

The procedure is advantageously carried out at a temperature of, for example, from 20 to 130° C., preferably from 50 to 120° C. and especially from 60 to 100° C. The treatment time may be, for example, from 10 to 90 minutes and preferably from 15 to 60 minutes.

A preferred embodiment of the invention comprises a method of dyeing natural or synthetic textile fibres, wherein the undyed textile fibre material is brought into contact with an aqueous exhaust dyeing liquor comprising at least one dye and a composition according to claim 1 at from 20 to 40° C. and at a pH of from 6 to 9 and the temperature is then raised to from 90 to 150° C., whereupon the pH decreases to from 4 to 7.

The liquor can comprise, in addition to the adjuvant according to the invention, further customary additives, such as electrolytes, e.g. sodium chloride or sodium sulfate, dispersants, wetting agents and antifoams Dyeing is carried out preferably using anionic dyes, any customary anionic dye, as described, for example, in Colour Index, 3rd edition (1971), being suitable.

Examples of anionic dyes include sulfo-group-containing monoazo, polyazo, metal complex azo, anthraquinone, phthalocyanine and formazan dyes.

The anionic dyes used in dyeing the fibre material are either in the form of their free sulfonic acids or in the form of their salts.

The dyes used in the dyeing of the fibre material may comprise further additives, e.g. sodium chloride or dextrin.

Dyeing of the fibre material can be carried out in accordance with customary dyeing or printing methods, for example in accordance with the padding or exhaust process. The dyeing liquors or printing pastes may comprise, in addition to water and the dyes, further additives, for example wetting agents, antifoams, levelling agents or agents that influence the characteristics of the textile material, for example softeners, flame-retardants, or dirt-, water- and oil-repellents, and also water-softeners and natural or synthetic thickeners, for example alginates and cellulose ethers.

The amounts in which dyes are used in the dye baths can vary within wide limits depending on the required depth of shade; in general, amounts of from 0.01 to 15% by weight, especially from 0.01 to 10% by weight, based on the material to be dyed, have proved to be advantageous.

Dyeing with anionic dyes or reactive dyes is preferably carried out at a pH of from 1 to 8 and especially from 2 to 7. The liquor ratio can be selected from within a wide range, for example from 1:3 to 1:50, preferably from 1:5 to 1:30. Dyeing is preferably carried out at from 50 to 130° C. and especially from 80 to 120° C.

Following the method according to the invention there are obtained dyeings of dyes, e.g. anionic dyes or reactive dyes, on polyamide fibre material, which dyeings are distinguished by a high degree of levelness.

The Examples that follow illustrate the invention.

EXAMPLE 1

Storage Stability

An adjuvant composition is prepared by mixing 60 parts by weight of ethylene glycol diformate, 1.5 parts by weight of imidazole and 38.5 parts by weight of dipropylene glycol (formulation 1). The concentrated product is stored for several weeks; for measurement of the pH, a 1% solution in demineralised water is prepared in each case. The 1% solution of a commercially available acid donor is used for comparison. The measured pH values are shown in Table 1.

TABLE 1

| Storage | pH value formulation 1 | pH value reference product |
|---|---|---|
| 0 weeks | 7.0 | 5.3 |
| 1 week | 6.6 | 5.0 |
| 4 weeks | 6.6 | 4.7 |
| 8 weeks | 6.7 | 4.5 |
| 12 weeks | 6.4 | 4.4 |

EXAMPLE 2

Dyeing of Polyamide Using Anionic Dye 5 g of polyamide fabric (PA 6.6) are immersed in 50 g of a liquor comprising 1% Eriofast® Red 3B (Ciba Specialty Chemicals) and 1 g/liter of formulation 1 (invention) or the reference product (comparison) at RT. The liquor is then heated to 98° C. at a heating rate of 2° C./min. After 60 minutes at 98° C., the liquor is cooled to 60° C. at 3° C./min.

The pH values measured during the dyeing process are given in Table 2.

TABLE 2

| Temperature | pH value formulation 1 | pH value reference product |
|---|---|---|
| 20° C. | 6.85 | 6.75 |
| 50° C. | 6.2 | 5.7 |
| 60° C. | 6.05 | 5.45 |
| 70° C. | 5.7 | 4.9 |
| 80° C. | 5.15 | 4.45 |
| 90° C. | 4.65 | 4.25 |
| 98° C. | 4.4 | 4.15 |

The dyeing with formulation 1 is distinguished by improved levelness and a more uniform appearance of the fabric.

EXAMPLE 3

Trichromatic Dyeing of Polyamide Using Anionic Dyes 5 g of polyamide fabric (PA 6.6) are immersed in 50 g of a liquor comprising 0.8% Erionyl® Yellow A-R (Ciba Specialty Chemicals), 0.4% Erionyl® Red A-2BF (Ciba Specialty Chemicals), 0.6% Erionyl® Blue A-R (Ciba Specialty Chemicals) and 2% Univadine® MC new (levelling agent, Ciba Specialty Chemicals) and, as the case may be, 0.5 g/liter, 1.0 g/liter or 4.0 g/liter of formulation 1 at 50° C. The liquor is then heated to 98° C. at a heating rate of 2° C./min. After 60 minutes at 98° C., the liquor is cooled to 50° C. at 3° C./min.

The pH values measured during the dyeing process are given in Table 3.

TABLE 3

| Temperature | pH value 0.5 g of formulation 1 | pH value 1.0 g of formulation 1 | pH value 4.0 g of formulation 1 |
|---|---|---|---|
| 50° C. | 7.2 | 7.0 | 6.5 |
| 10 min at 50° C. | 6.7 | 6.5 | 6.0 |

TABLE 3-continued

| Temperature | pH value 0.5 g of formulation 1 | pH value 1.0 g of formulation 1 | pH value 4.0 g of formulation 1 |
|---|---|---|---|
| 60° C. | 6.4 | 6.2 | 5.2 |
| 70° C. | 6.2 | 5.8 | 5.1 |
| 80° C. | 6.0 | 5.6 | 4.6 |
| 90° C. | 5.7 | 5.0 | 4.2 |
| 98° C. | 5.2 | 4.5 | 3.9 |
| 30 min at 98° C. | 4.8 | 4.2 | 3.4 |
| 60 min at 98° C. | 4.6 | 4.0 | 3.1 |
| 50° C. | 4.9 | 4.3 | 3.5 |

The brown dyeings thereby obtained are distinguished by improved levelness and a more uniform appearance of the fabric.

EXAMPLE 4

Trichromatic Dyeing of Polyamide Using Anionic Dyes 5 g of polyamide fabric (PA 6.6) are immersed in 50 g of a liquor comprising 0.4% Erionyl® Yellow A-R (Ciba Specialty Chemicals), 0.6% Erionyl® Red A-2BF (Ciba Specialty Chemicals), 0.8% Erionyl® Blue A-R (Ciba Specialty Chemicals) and 2% Univadine® MC new (Ciba Specialty Chemicals) and, as the case may be, 0.5 g/liter, 1.0 g/liter or 2.0 g/liter of formulation 1 at 50° C. The liquor is then heated to 98° C. at a heating rate of 2° C./min. After 60 minutes at 98° C., the liquor is cooled to 50° C. at 3° C./min.

The violet dyeings thereby obtained are distinguished by improved levelness and a more uniform appearance of the fabric.

EXAMPLE 5

Trichromatic Dyeing of Polyamide Using Anionic Dyes 5 g of polyamide fabric (PA 6.6) are immersed in 50 g of a liquor comprising 0.73% Eriofast® Yellow R (Ciba Specialty Chemicals), 0.43% Eriofast® Red 2B (Ciba Specialty Chemicals), 0.76% Eriofast® Blue 3R (Ciba Specialty Chemicals) and 2% Univadine® MC new (Ciba Specialty Chemicals), 0.5 g/liter of Cibatex® AD-40 (Ciba Specialty Chemicals) and, as the case may be, 1.0 g/liter, 2.0 g/liter or 4.0 g/liter of a formulation consisting of 45 parts by weight of diethylene glycol bischloroacetate, 2.5 parts by weight of 2,4-lutidine and 52.5 parts by weight of dipropylene glycol at 40° C. The liquor is then heated to 98° C. at a heating rate of 2° C./min. After 60 minutes at 98° C., the liquor is cooled to 40° C. at 3° C./min.

The violet dyeings thereby obtained are distinguished by improved levelness and a more uniform appearance of the fabric, which is to be attributed to the more uniform course of the pH during dyeing.

EXAMPLE 6

Trichromatic Dyeing of Polyamide Using Anionic Dyes 5 g of polyamide fabric (PA 6.6) are immersed in 50 g of a liquor comprising 0.73% Eriofast® Yellow R (Ciba Specialty Chemicals), 0.43% Eriofast® Red 2B (Ciba Specialty Chemicals), 0.76% Eriofast® Blue 3R (Ciba Specialty Chemicals) and 2% Univadine® MC new (Ciba Specialty Chemicals), 0.5 g/liter of Cibatex® AD-40 (Ciba Specialty Chemicals) and, as the case may be, 1.0 g/liter, 2.0 g/liter or 4.0 g/liter of a formulation consisting of 45 parts by weight of ethylene glycol di(hydroxyacetate), 2.5 parts by weight of 2,4-lutidine and 52.5 parts by weight of dipropylene glycol at 40° C. The liquor is then heated to 98° C. at a heating rate of 2° C./min. After 60 minutes at 98° C., the liquor is cooled to 40° C. at 3° C./min.

The violet dyeings thereby obtained are distinguished by improved levelness and a more uniform appearance of the fabric, which is to be attributed to the more uniform course of the pH during dyeing.

EXAMPLE 7

Trichromatic Dyeing of Polyamide Using Anionic Dyes 5 g of polyamide fabric (PA 6.6) are immersed in 50 g of a liquor comprising 0.73% Eriofast® Yellow R (Ciba Specialty Chemicals), 0.43% Eriofast® Red 2B (Ciba Specialty Chemicals), 0.76% Eriofast® Blue 3R (Ciba Specialty Chemicals) and 2% Univadine® MC new (Ciba Specialty Chemicals), 0.5 g/liter of Cibatex® AD-40 (Ciba Specialty Chemicals) and, as the case may be, 1.0 g/liter, 2.0 g/liter or 4.0 g/liter of a formulation consisting of 45 parts by weight of ethylene glycol bisoxalate, 2.5 parts by weight of 2,4-lutidine and 52.5 parts by weight of dipropylene glycol at 40° C. The liquor is then heated to 98° C. at a heating rate of 2° C./min. After 60 minutes at 98° C., the liquor is cooled to 40° C. at 3° C./min.

The violet dyeings thereby obtained are distinguished by improved levelness and a more uniform appearance of the fabric, which is to be attributed to the more uniform course of the pH during dyeing.

EXAMPLE 8

Trichromatic Dyeing of Polyamide Using Anionic Dyes 5 g of polyamide fabric (PA 6.6) are immersed in 50 g of a liquor comprising 0.73% Eriofast® Yellow R (Ciba Specialty Chemicals), 0.43% Eriofast® Red 2B (Ciba Specialty Chemicals), 0.76% Eriofast® Blue 3R (Ciba Specialty Chemicals) and 2% Univadine® MC new (Ciba Specialty Chemicals), 0.5 g/liter of Cibatex® AD-40 (Ciba Specialty Chemicals) and, as the case may be, 0.5 g/liter or 4.0 g/liter of formulation 1 at 40° C. The liquor is then heated to 98° C. at a heating rate of 2° C./min. After 60 minutes at 98° C., the liquor is cooled to 70° C. at 3° C./min and is then made alkaline by adding 1 g/liter of $Na_2CO_3$. The pH values measured during the dyeing process are given in Table 4.

TABLE 4

| Temperature | pH value 0.5 g of formulation 1 | pH value 4.0 g of formulation 1 |
|---|---|---|
| 40° C. | 7.4 | 6.6 |
| 10 min at 40° C. | 7.1 | 6.3 |
| 50° C. | 7.0 | 5.9 |
| 60° C. | 6.6 | 5.5 |
| 70° C. | 6.3 | 5.0 |
| 80° C. | 6.0 | 4.8 |

TABLE 4-continued

| Temperature | pH value 0.5 g of formulation 1 | pH value 4.0 g of formulation 1 |
|---|---|---|
| 90° C. | 5.9 | 4.2 |
| 98° C. | 5.6 | 4.0 |
| 30 min at 98° C. | 5.0 | 3.6 |
| 60 min at 98° C. | 4.9 | 3.2 |
| 70° C. | 4.9 | 3.1 |
| addition of 1 g/litre of $Na_2CO_3$ 10 min at 70° C. | 10.6 | 10.0 |

The brown dyeings thereby obtained are distinguished by improved levelness and a more uniform appearance of the fabric.

EXAMPLE 9

Trichromatic Dyeing of Polyamide Using Metal Complex Dyes 5 g of polyamide fabric (PA 6.6) are immersed in a liquor comprising 0.6% Lanaset® Yellow 2R (Ciba Specialty Chemicals), 0.6% Lanaset® Red G (Ciba Specialty Chemicals), 0.4% Lanaset® Grey G (Ciba Specialty Chemicals) and 2% Univadine® MC new (levelling agent, Ciba Specialty Chemicals) and, as the case may be, 0.5 g/liter, 1.0 g/liter or 4.0 g/liter of formulation 1 at 50° C. The liquor is then heated to 98° C. at a heating rate of 2° C./min. After 60 minutes at 98° C., the liquor is cooled to 50° C. at 3° C./min.

The pH values measured during the dyeing process are given in Table 5.

TABLE 5

| Temperature | pH value 0.5 g of formulation 1 | pH value 1.0 g of formulation 1 | pH value 4.0 g of formulation 1 |
|---|---|---|---|
| 50° C. | 7.1 | 7.1 | 6.4 |
| 10 min at 50° C. | 6.6 | 6.5 | 5.9 |
| 60° C. | 6.3 | 6.1 | 5.4 |
| 70° C. | 6.1 | 5.9 | 5.1 |
| 80° C. | 5.9 | 5.5 | 4.6 |
| 90° C. | 5.5 | 5.0 | 4.2 |
| 98° C. | 5.1 | 4.6 | 3.9 |
| 30 min at 98° C. | 4.6 | 4.1 | 3.3 |
| 60 min at 98° C. | 4.7 | 3.9 | 3.0 |
| 50° C. | 4.9 | 4.2 | 3.5 |

The beige dyeings thereby obtained are distinguished by improved levelness and a more uniform appearance of the fabric.

EXAMPLE 10

Trichromatic Dyeing of Polyamide Using Metal Complex Dyes 5 g of polyamide fabric (PA 6.6) are immersed in 50 g of a liquor comprising 0.028% Irgalan® Yellow 3RL 250% (Ciba Specialty Chemicals), 0.049% Irgalan® Grey GLN (Ciba Specialty Chemicals), 0.029% Irgalan® Blue 3GL 200% (Ciba Specialty Chemicals), 0.021% Irgalan® Bordeaux EL 200% (Ciba Specialty Chemicals), 0.019% Irgalan® Yellow GRL 200% (Ciba Specialty Chemicals) and 2% Univadine® MC new (levelling agent, Ciba Specialty Chemicals) and 0.5 g/liter of formulation 1 at 40° C. The liquor is then heated to 98° C. at heating a rate of 2° C./min. The pH values measured during the dyeing process are given in Table 6.

TABLE 6

| Temperature | pH value 0.5 g of formulation 1 |
|---|---|
| 40° C. | 7.4 |
| 10 min at 40° C. | 7.0 |
| 50° C. | 6.9 |
| 60° C. | 6.7 |
| 70° C. | 6.5 |
| 80° C. | 6.1 |
| 90° C. | 5.7 |
| 98° C. | 5.5 |
| 30 min at 98° C. | 5.0 |
| 60 min at 98° C. | 4.8 |

The beige dyeings thereby obtained are distinguished by improved levelness and a more uniform appearance of the fabric.

EXAMPLE 11

Trichromatic Dyeing of Wool Using Anionic Dyes

Various woollen fabrics are dyed in an Ahiba laboratory dyeing apparatus using a method that is customary for dyeing wool. In the process, 10 g of loose wool are treated in 400 ml of a liquor comprising 0.45% Lanasol Yellow 4G (Ciba Specialty Chemicals), 0.60% Lanasol Red 6G (Ciba Specialty Chemicals), 0.45% Lanasol Blue 3G (Ciba Specialty Chemicals) and 0.5 g/l Cibaflow® CIR (wetting agent, Ciba Specialty Chemicals), 1.0% Albegal® (amphoteric surfactant, Bayer), 5.0% Glauber's salt and, as the case may be, 1.0 g/liter or 4.0 g/liter of formulation 1. The pH values measured during the dyeing process are given in Tables 7a-7c.

TABLE 7a

Substrate: Austral loose wool (tippy wool)

| Temperature | pH value 1.0 g of formulation 1 | pH value 4.0 g of formulation 1 |
|---|---|---|
| 50° C. | 6.5 | 5.5 |
| 60° C. | 6.4 | 5.3 |
| 70° C. | 5.8 | 4.8 |
| 80° C. | 5.4 | 4.5 |
| 90° C. | 5.0 | 4.2 |
| 98° C. | 4.8 | 3.9 |
| 30 min at 98° C. | 4.4 | 3.6 |
| 60 min at 98° C. | 4.4 | 3.4 |
| 70° C. | 5.0 | 4.0 |
| 40° C. | 4.9 | 4.0 |

TABLE 7b

Substrate: chlorinated wool fabric (Basolan DC)

| Temperature | pH value 1.0 g of formulation 1 | pH value 4.0 g of formulation 1 |
|---|---|---|
| 50° C. | 6.3 | 5.4 |
| 60° C. | 6.1 | 5.3 |
| 70° C. | 5.6 | 4.8 |
| 80° C. | 5.1 | 4.5 |
| 90° C. | 4.8 | 4.1 |
| 98° C. | 4.5 | 3.8 |

TABLE 7b-continued

Substrate: chlorinated wool fabric (Basolan DC)

| Temperature | pH value 1.0 g of formulation 1 | pH value 4.0 g of formulation 1 |
|---|---|---|
| 30 min at 98° C. | 4.3 | 3.5 |
| 60 min at 98° C. | 4.2 | 3.3 |
| 70° C. | 4.8 | 4.0 |
| 40° C. | 4.8 | 4.0 |

TABLE 7c

Substrate: Hercosett wool yarn

| Temperature | pH value 1.0 g of formulation 1 | pH value 4.0 g of formulation 1 |
|---|---|---|
| 50° C. | 6.4 | 5.8 |
| 60° C. | 6.3 | 5.5 |
| 70° C. | 5.9 | 4.9 |
| 80° C. | 5.5 | 4.5 |
| 90° C. | 5.1 | 4.1 |
| 98° C. | 4.8 | 3.9 |
| 30 min at 98° C. | 4.4 | 3.5 |
| 60 min at 98° C. | 4.3 | 3.3 |
| 70° C. | 5.0 | 4.0 |
| 40° C. | 4.9 | 4.0 |

The brown dyeings thereby obtained are distinguished by substantially better tone-in-tone build-up, improved levelness and less skitteriness (lack of levelness).

What is claimed is:

1. An adjuvant composition consisting of (A) from 20 to 95% by weight of a $C_1$-$C_2$ carboxylic acid ester of a polyhydroxy compound containing from 2 to 20 hydroxyl groups and (B) from 0.2 to 10% by weight of an N-heterocyclic compound having a $pK_a$ value of from 6 to 8; and (C) from to 70% by weight of a glycol or glycol ether of formula (1)

$$R_1—(OCHR_3CH_2)_n—OCHR_3CH_2OR_2 \quad (1),$$

wherein $R_1$ and $R_2$ are hydrogen or $C_1$-$C_{12}$ alkyl, with the proviso that at least one of the radicals $R_1$ and $R_2$ hydrogen, $R_3$ is hydrogen or methyl, and n is a number from 0 to 8, the sum of components (A)+(B)+(C) being, in each case 100% by weight.

2. A composition according to claim 1, wherein component A is a $C_1$-$C_2$ carboxylic acid ester of ethylene glycol or propylene glycol, of a polyethylene glycol or polypropylene glycol, of glycerol, of a glycerol/ethylene oxide addition product or a glycerol/propylene oxide addition product, of glucose, of a glucose/ethylene oxide addition product or glucose/propylene oxide addition product.

3. A composition according to claim 1, wherein component A is a the reaction product of a $C_1$-$C_2$ carboxylic acid with ethylene glycol, polyethylene glycol containing from 2 to 4 ethylene groups, propylene glycol, polypropylene glycol containing from 2 to 4 propylene groups, glycerol, glycerol/ethylene oxide addition product containing from 2 to 6 ethylene groups or glycerol/propylene oxide addition product containing from 2 to 6 propylene groups.

4. A composition according to claim 1, wherein component A is a formic acid ester, chloroacetic acid ester, hydroxyacetic acid ester or oxalic acid ester of a polyhydroxy compound containing from 2 to 20 hydroxyl groups.

5. A composition according to claim 1, wherein component A is a ethylene glycol monoformate, ethylene glycol diformate, diethylene glycol monoformate, diethylene glycol diformate, ethylene glycol mono(chloroacetate), ethylene glycol di(chloroacetate), diethylene glycol mono(chloroacetate), diethylene glycol di(chloroacetate), ethylene glycol mono-(hydroxyacetate), ethylene glycol di(hydroxyacetate), diethylene glycol mono(hydroxy-acetate), diethylene glycol di(hydroxyacetate), ethylene glycol mono(oxalate), ethylene glycol di(oxalate), diethylene glycol mono(oxalate) or diethylene glycol di(oxalate).

6. A composition according to claim 1, wherein component B is a morpholine, imidazole, pyridine, quinoline or isoquinoline compound.

7. A composition according to claim 1, wherein component B is a imidazole or 2,4-lutidine.

8. A composition according to claim 1, consisting of components A and B in a weight ratio of from 500:1 to 4:1.

9. A composition according to claim 1, wherein component C is a glycol of formula (1) wherein $R_1$ and $R_2$ are hydrogen and n is a number from 0 to 2.

10. A composition according to claim 1, wherein component C is, dipropylene glycol.

11. A method of controlling pH in a textile-processing process, wherein the processing liquor comprises a composition according to claim 1.

12. A method according to claim 11, wherein the textile-processing process is a dyeing method.

13. A method of dyeing natural or synthetic textile fibres, wherein the undyed textile fibre material is brought into contact with an aqueous exhaust dyeing liquor comprising at least one dye and a composition according to claim 1 at from 20 to 40° C. and at a pH of from 6 to 9 and the temperature is then raised to from 90 to 150° C., whereupon the pH decreases to from 4 to 7.

* * * * *